US008191570B2

(12) United States Patent
Purkis

(10) Patent No.: US 8,191,570 B2
(45) Date of Patent: Jun. 5, 2012

(54) BI-DIRECTIONAL FLAPPER VALVE

(75) Inventor: Daniel Purkis, Aberdeenshire (GB)

(73) Assignee: Petrowell Limited, Aberdeen (GB)

( * ) Notice: Subject to any disclaimer, the term of this patent is extended or adjusted under 35 U.S.C. 154(b) by 773 days.

(21) Appl. No.: 12/226,577

(22) PCT Filed: Apr. 26, 2007

(86) PCT No.: PCT/GB2007/001547

§ 371 (c)(1),
(2), (4) Date: Oct. 22, 2008

(87) PCT Pub. No.: WO2007/125335

PCT Pub. Date: Nov. 8, 2007

(65) Prior Publication Data

US 2009/0230340 A1 Sep. 17, 2009

(30) Foreign Application Priority Data

Apr. 27, 2006 (GB) ..... 0608334.9

(51) Int. Cl.
*F16K 17/26* (2006.01)

(52) U.S. Cl. ..... 137/493.9; 251/82; 166/332.8; 166/334.1

(58) Field of Classification Search ..... 137/493, 137/493.9, 270; 251/82, 83; 166/332.1, 166/332.8, 334.1
See application file for complete search history.

(56) References Cited

U.S. PATENT DOCUMENTS

| | | | | |
|---|---|---|---|---|
| 2,768,695 | A | 4/1953 | Althouse, Jr. et al. | |
| 2,812,820 | A * | 11/1957 | Nelson | 166/325 |
| 3,470,903 | A * | 10/1969 | Scott | 137/467 |
| 4,537,213 | A * | 8/1985 | Molina | 137/269.5 |
| 5,095,994 | A * | 3/1992 | Dollison | 166/386 |
| 6,227,299 | B1 * | 5/2001 | Dennistoun | 166/332.8 |
| 6,328,109 | B1 * | 12/2001 | Pringle et al. | 166/373 |
| 7,363,980 | B2 * | 4/2008 | Pringle | 166/319 |
| 7,743,787 | B2 * | 6/2010 | Baugh | 137/508 |
| 2001/0032675 | A1 * | 10/2001 | Russell | 137/493.9 |
| 2003/0173091 | A1 * | 9/2003 | Horne et al. | 166/386 |
| 2003/0209350 | A1 * | 11/2003 | Laurel | 166/373 |
| 2005/0039922 | A1 * | 2/2005 | Vick et al. | 166/332.8 |
| 2006/0196675 | A1 * | 9/2006 | Patel et al. | 166/374 |
| 2007/0246225 | A1 * | 10/2007 | Hailey et al. | 166/386 |

FOREIGN PATENT DOCUMENTS

| | | |
|---|---|---|
| GB | 2 443 109 | 4/2008 |
| WO | WO 03/054347 | 7/2003 |

OTHER PUBLICATIONS

Search Report, GB1103207.5, dated Apr. 1, 2011, 1 page.
Combined Search and Examination Report, GB 1103207.5, dated Apr. 4, 2011, 2 pages.

* cited by examiner

*Primary Examiner* — John Rivell
*Assistant Examiner* — Minh Le
(74) *Attorney, Agent, or Firm* — Drinker Biddle & Reath LLP

(57) ABSTRACT

The invention provides a valve assembly comprising a conduit with a bore 1*b* for passage of fluid therethrough. The valve assembly also comprises a sealing member that is movable within the conduit to open and close the bore. The seal assembly has a valve seat on which the sealing member seals when the bore is closed, and wherein the valve seat is movable within the conduit. The invention also provides a valve assembly comprising a sealing member, a first valve seat for the sealing member, and a second valve seat for the sealing member. The valve assemblies can be resettable. The invention further provides a flapper valve assembly wherein the flapper is pivotable through more than 90° and a bi-directional flapper valve assembly.

20 Claims, 7 Drawing Sheets

BI-DIRECTIONAL FLAPPER VALVE

FIELD OF THE INVENTION

This invention relates to a valve assembly, particularly to a flapper valve assembly.

BACKGROUND

Flapper valves are widely used in fluid conduits that transfer fluids between an oil well reservoir and a wellhead. Flapper valves are typically one-way valves that are hinged at one side of the conduit so that in an open configuration they are disposed generally parallel to the conduit, out of the bore, but can pivot over to a closed position in which they occlude the bore of the conduit and lie across its axis. In the closed position, flapper valves typically seal against an annular seat on the inner bore of the conduit, and fluid pressure behind the flapper typically keeps the flapper tightly closed against the seat, as long as the pressure differential across the flapper persists.

The flapper can move back into its original open position if the pressure differential across the seat is removed or reversed, allowing fluids to flow in one direction, but retaining pressure in the other.

Conventional flapper valves necessarily hold pressure in only one direction, and permit fluid transmission in the other.

SUMMARY OF THE INVENTION

The invention provides a valve assembly having a conduit with a bore for passage of fluid, a sealing member that is movable within the conduit to open and close the bore, and wherein the seal assembly has a valve seat on which the sealing member seals when the bore is closed, and wherein the valve seat is movable within the conduit.

Typically, the valve seat is movable from a sealing configuration in which the sealing member engages with the valve seat to seal the bore, and an open configuration, in which the sealing member cannot engage the seat.

The seat is typically axially movable within the bore.

Typically, the sealing member has a first open configuration in which the bore of the valve assembly is open, and a second configuration in which the bore is closed, and fluid passage is restricted. Typically, there is also a third configuration of the sealing member where the bore is open.

The sealing member can be pivotally movable within the bore, and the seat can be movable axially relative to the pivot point of the sealing member.

According to the present invention there is also provided a valve assembly for a fluid conduit, the assembly comprising a sealing member, a first valve seat for the sealing member, and a second valve seat for the sealing member.

The sealing member can be a flapper.

At least one (and typically each) of the first and second valve seats can move relative to the flapper. The flapper can typically seal against one or other (or both) of the seats.

Typically, the flapper can move from a first open configuration to a closed configuration, and typically also can adopt a third (open) configuration. Typically, the flapper is hinged at one side and the hinge permits pivotal movement through more than 90° of rotation around the hinge. Typically, the hinge permits more than 180° of movement from the first open position (for example, up to 190° of movement), so that the third open position can be rotated through more than 90° with respect to the first open position. Typically, this figure is approximately 180°, although the exact degree of rotation does not matter; it is sufficient for the third open position of the flapper to be on the other side of the hinge than the first.

Typically, in a first configuration, the flapper can move in a first arc, and in the second configuration, the flapper can move in a second, different arc.

The flapper is typically biased by a spring device from the first open configuration towards the second and third configurations. Typically, the spring can be an extension spring, as this permits high spring forces, although in some embodiments the spring device can be a torsion spring.

The valve seats are typically movable axially within the conduit. The valve seats are typically mounted on the end faces of sleeves that slide within the bore of the conduit. The sleeves can be urged by spring devices to move them through the conduit. Electric (or other) motors can be used instead of springs.

The invention also provides a flapper valve assembly, wherein the flapper is pivotable through more than 90°.

The valve assembly can be resettable. The valve assembly can comprise a reset system the actuation of which can cause movement of the valve assembly from the closed to the open configuration. The reset system can be actuable to move at least one of the first and second valve seat to a predetermined position.

The valve assembly can be actuable by any of the following means: a timer; a radio frequency signal; a strain gauge; a pressure pulse; a chemical; and an electromagnetic induction.

Where the valve assembly incorporates a reset system, the reset system can be responsive to any of the following means: a timer; a radio frequency signal; a strain gauge; a pressure pulse; a chemical; and an electromagnetic induction for selective movement of the valve assembly into a predetermined configuration.

The invention also provides a bi-directional flapper valve assembly.

BRIEF DESCRIPTION OF THE DRAWINGS

Embodiments of the present invention will now be described by way of example, and with reference to the accompanying drawings, in which.

DESCRIPTION OF THE PREFERRED EMBODIMENTS

Figure 1:
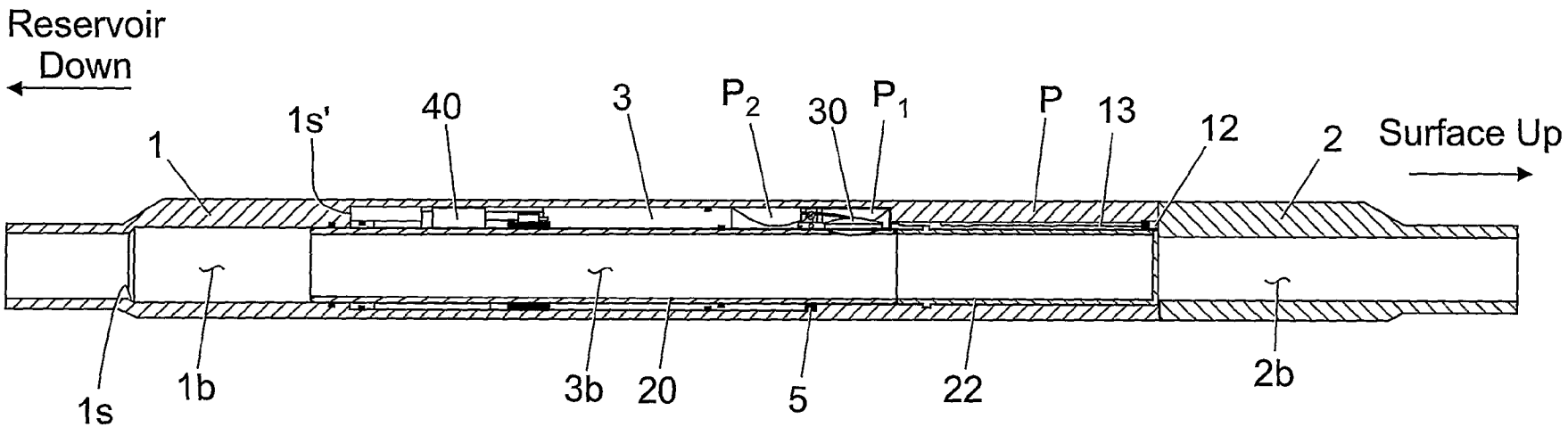
FIG. 1 is a side-sectional view of a valve assembly in a first (open) configuration.
Figure 2:
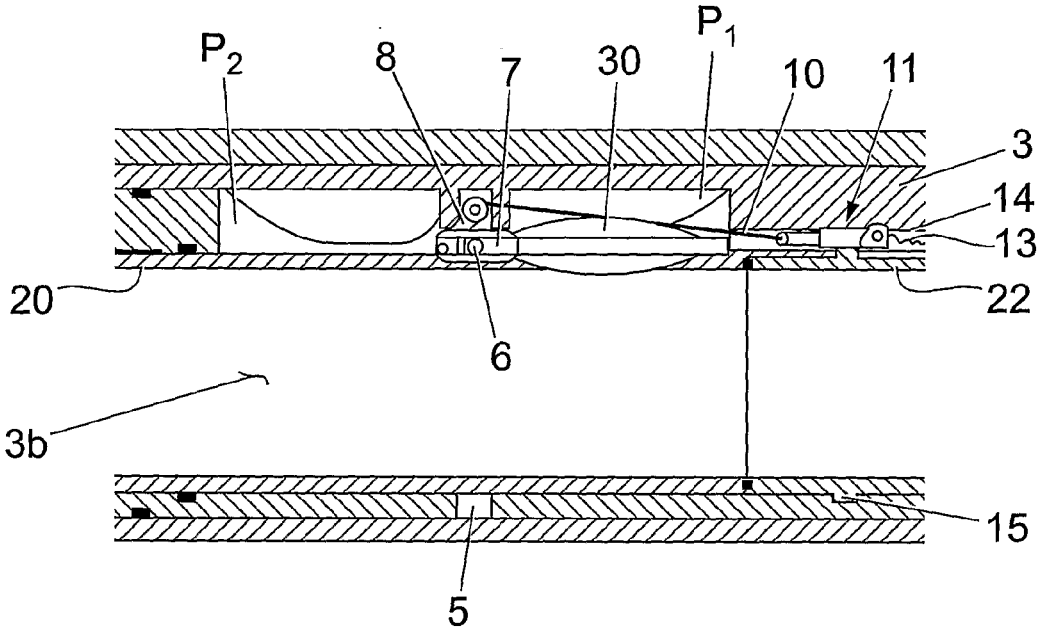
FIG. 2 is a close up view of a flapper of the valve assembly of FIG. 1, shown in the first (open) configuration.
Figure 3:
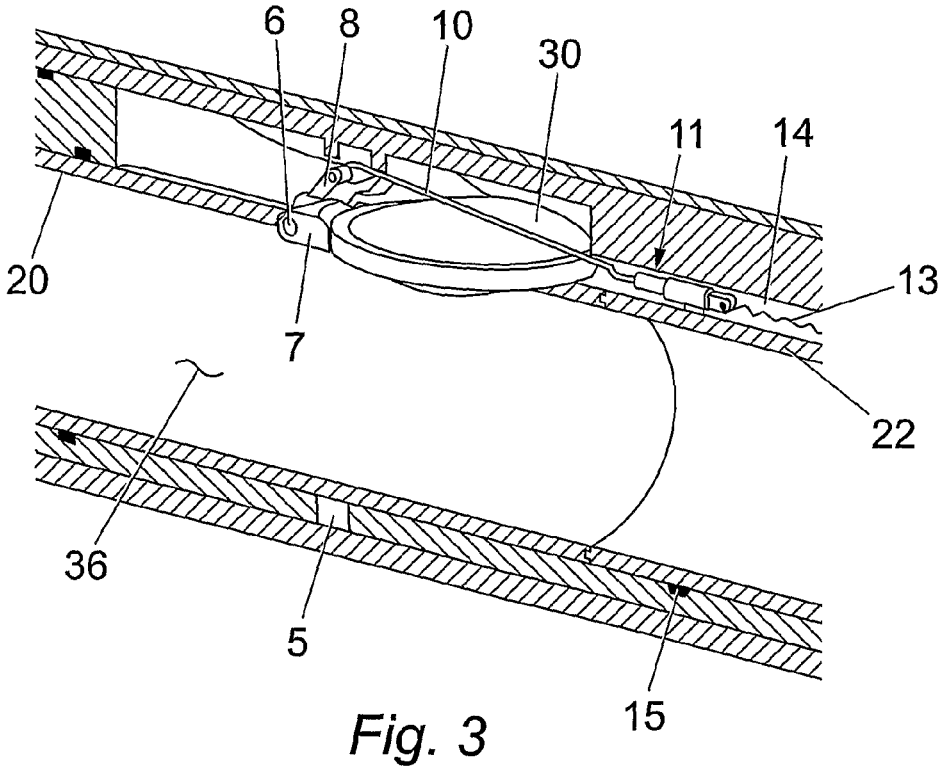
FIG. 3 is a perspective view of the FIG. 2 flapper.
Figure 4:
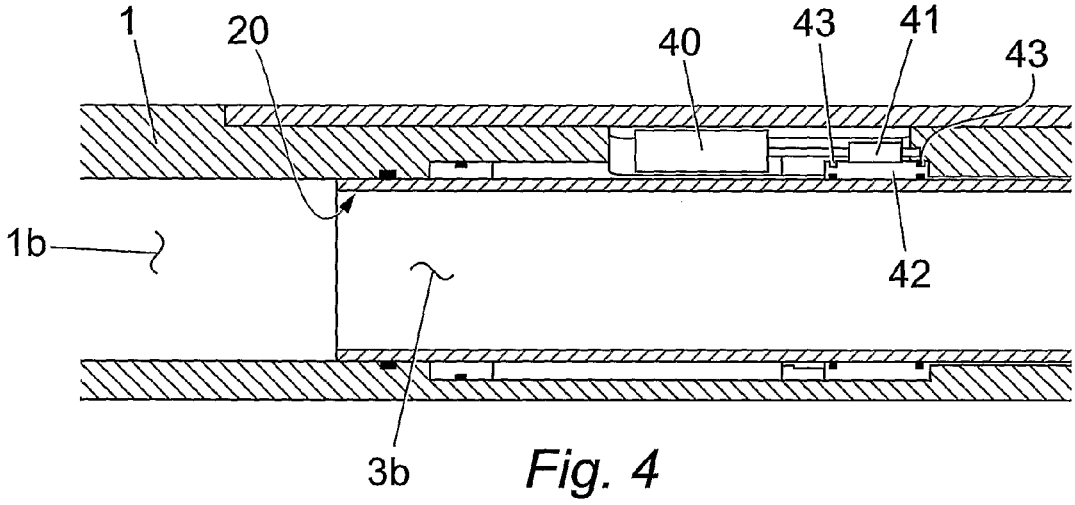
FIG. 4 shows a motor sub portion of the FIG. 1 valve assembly in the first configuration.

Referring now to the drawings, FIG. 1 shows a side-sectional view of a valve assembly. The valve assembly has an outer casing formed by a tubular housing 1, which is set in a string below an upper sub 2. The respective ends of the housing 1 and upper sub 2 can have conventional end connectors (e.g. box/pin etc) in order to make up the valve assembly into a tubing string such as a production tubing string for the recovery of production fluids from hydrocarbon reservoirs. The housing 1 has an annular bore to contain the various inner components, and to act as a conduit for the flow of fluids through the housing 1 and upper sub 2.

Figure 12:
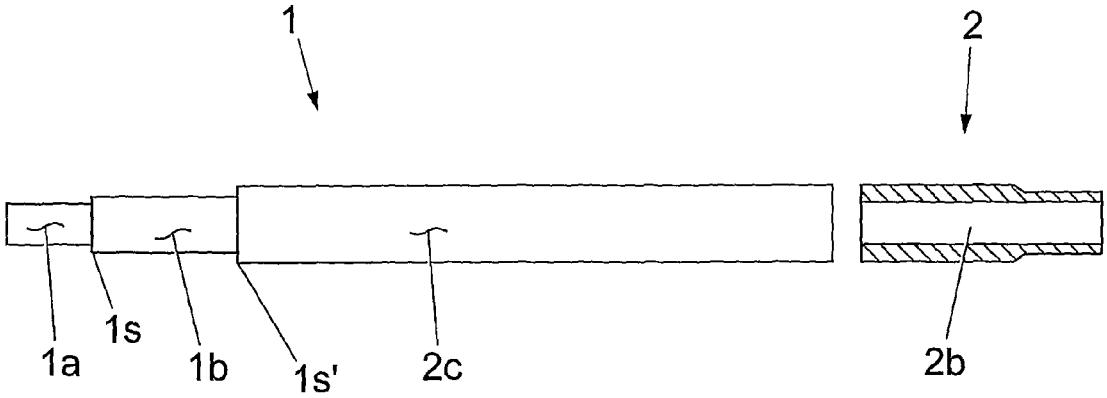
FIG. 12 is a side sectional view of a housing of the FIG. 1 valve assembly.

The housing 1 has different internal diameters along its length, as best shown in FIG. 12. At the lower end of the housing 1, the lower bore 1*a* has a narrow inner diameter for connection to tubing string below the housing. The inner diameter increases stepwise at a first annular, shoulder 1*s* to form a middle bore 1*b*, and again at a second annular shoulder 1*s*' to form an upper bore 1*c*. The upper bore 1*c* accommodates a pocketed spacer 3 set between the second annular shoulder 1*s*' and the upper sub 2. The pocketed spacer 3 incorporates the flapper mechanism within it, and can optionally be sealed in the upper bore 1*c* by or O-rings, or the like.

The pocketed spacer 3 has an inner bore 3*b* that is coaxial with the middle bore 1*b* of the housing between the first and second annular shoulders 1*s* and 1*s*'. The bore 3*b* of the pocketed spacer 3 has the same inner diameter as the middle bore 1*b*, so when the pocketed spacer 3 is in place within the housing 1, the bore 3*b* in the pocketed spacer 3 effectively constitutes a continuous extension of the middle bore 1*b*. This combined bore accommodates a lower flow tube 20 and a upper flow tube 22. The outer diameter of the flow tubes 20 and 22 are a sealing fit within the bore 3*b* of the pocketed spacer 3 and within the middle bore 1*b* of the housing, but the flow tubes 20, 22 are too wide to pass the shoulder 1*s*, or to enter the narrow bore 2*b* of the upper sub 2. The flow tubes are, however, dimensioned to be slidable within the bores 1*b* and 3*b*.

The narrower bore 2*b* of the upper flow sub 2 prevents the upper flow tube 22 from moving up after it has shouldered out on the upper sub 2. Likewise, the annular shoulder 1*s* at the lower end of the housing is narrower than the lower flow tube 20, and thereby restrains its downward movement within the bore 1*b* of the housing 1. Optionally the flow tubes 20, 22 can be sealed within the bores 1*b*/3*b* by O-ring seals etc, although in some embodiments this is not necessary.

The bore 3*b* of the pocketed spacer 3 is a fluid conduit for production fluids flowing from a reservoir below the housing, and a flapper 30 is provided to close the bore 3*b* of the pocketed spacer 3, and to control the flow. It is often required to set a packer or to pressure test the conduit prior to other operations commencing and the valve assembly described is useful for providing the barrier to conduct these operations, and then being removed to permit two-way flow once the testing or packer setting operations have been completed.

The pocketed spacer has a first pocket p1 and a second pocket p2 disposed on one side of the bore 3*b*. The pockets p1 and p2 are axially disposed below and above an annular hinge ringer 5 that is set in an annular recess in the pocketed spacer 3. The pockets p1 and p2 are typically symmetrical to one another, and are each sized to accommodate the flapper 30 when it is folded parallel to the axis of the bore 3*b*.

When the assembly is in the configuration shown in FIG. 1, the flapper 30 is in the first (open) configuration, and is tucked away out of the bore 3*b*, in the first pocket p1 on the pocketed spacer 3, parallel to the axis of the bore 3*b*. The first pocket p1 is typically located above the second pocket p2.

The flapper 30 is pivotally mounted on a pivot pin 6 passing through a lever 7 on one side of the flapper 30. The pin 6 is anchored on the annular hinge ringer 5. The annular hinge ringer 5 is located at the mid point between the two pockets p1 and p2, so that the flapper 30 can move into either pocket p1, p2, by pivoting around the pin 6.

An elbow link 8 is pivotally attached to a second pin extending through the lever 7, and a linkage arm 10 connects the elbow link 8 to a locking pin 11 located in a narrow axial bore 14 set above the flapper 30 in the pocketed spacer 3. The narrow axial bore 14 in which the locking pin 11 is located houses an extension spring 13 held in tension between the locking pin 11 and a spring anchor 12 fixed in the lower end of the bore 14 adjacent to the upper sub 2. The tension in the spring 13 pulls the linkage arm 10 up towards the upper sub 2. This tension is transmitted to the flapper 30 via the link member 8 and the lever 7, which urges the flapper 30 to move clockwise in the figures around the pivot pin 6, out of the first pocket p1 and into the bore 3*b*. However, the flapper 30 can only pivot out of the pocket p1 when it is unlatched from the spacer 3, and when the bore is not obstructed by a flow tube. Thus, when the lower flow tube 20 occludes the bore 3*b*, it prevents the flapper 30 from rotating out of the pocket p1.

Figure 11:
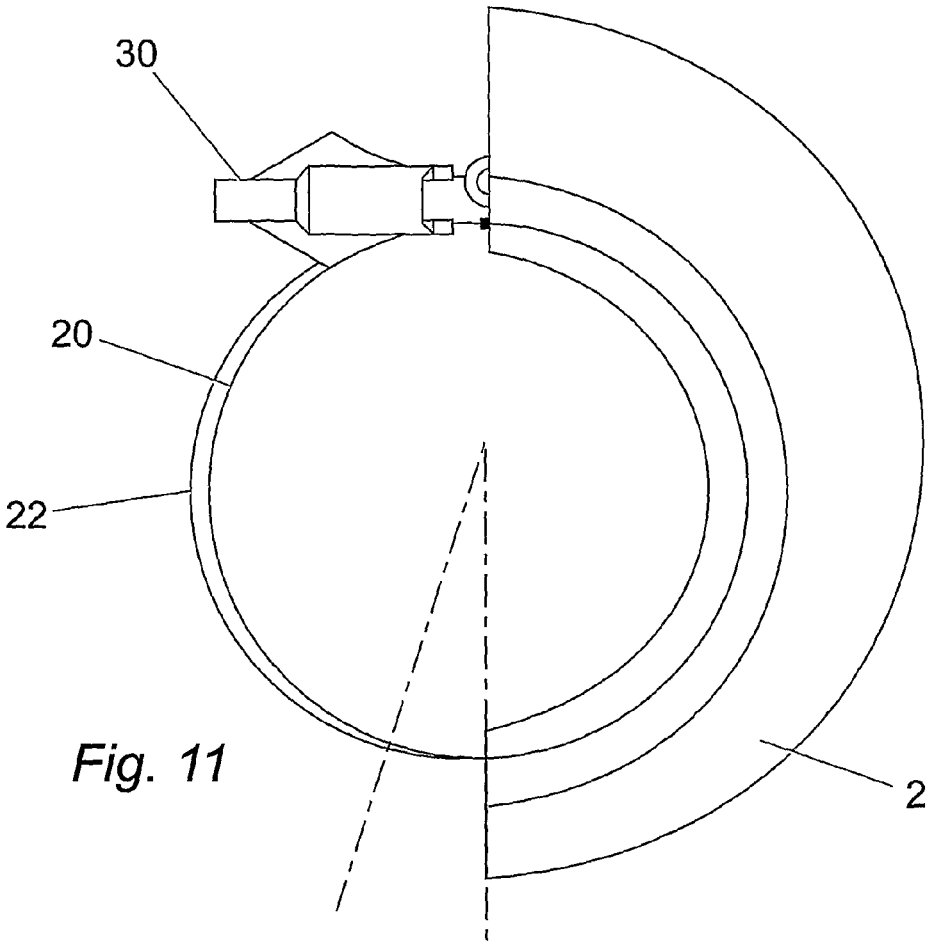
FIG. 11 is an end view of the valve assembly shown in the earlier figures.

As shown in FIGS. 1 to 4, in the first (open) configuration, the lower flow tube 20 occupies a position straddling both of the pockets p1 and p2 in the pocketed spacer 3. As shown in FIG. 11, the flapper 30 has a concave profile on each face, which matches the outer profiles of the flow tubes 20, 22. Thus while the lower flow tube 20 is disposed across the pocket p1, the flapper 30 is constrained within the pocket and cannot occlude the bore 3*b*. In certain embodiments, the flapper 30 can be constrained within either pocket (or in another position) by a latch means (not shown) independently of the flow tubes, to prevent the spring 14 from moving the flapper 30 until the latch is released.

The lower flow tube 20 can be moved axially within the bore 3*b* by means of an electric motor 40 (FIG. 4) which rotates a worm gear 41 that meshes with external striations on an annular nut 42 surrounding the lower flow tube 20 and held between thrust bearings 43 on the outer surface of the lower flow tube 20. The threads on the inner diameter of the threaded nut 42 mesh with corresponding threads on the outer diameter of the lower flow tube 20, so that as the electric motor 40 rotates the worm gear 41, the threaded nut 42 held axially between the thrust bearings 43 rotates around its axis, causing relative axial movement of the lower flow tube 20 within the bore 1*b*. Thus, the lower flow tube 20 can be moved axially in either direction, in accordance with the direction of rotation of the electric motor 40.

In some embodiments, the motor 40, worm gear 41 and threads on the threaded nut 42 are chosen so that the lower flow tube 20 only moves a small distance for each rotation of the nut 42. This enables very precise axial movements of the lower flow tube 20, so that its exact position within the housing 1 can be known in accordance with the readings from (or signals to) the electric motor 40. The motor can be programmed to execute a certain number of rotations of the motor (corresponding to a precise axial translocation of the flow tube 20) when it receives a signal to do so. The motor can be programmed to execute a pattern of movements corresponding to several different axial positions of the flow tube 20.

In some embodiments, the striated nut 42 can be replaced by a ball screw.

The axial position of the upper flow tube 22 within the bore of the pocketed spacer is typically restrained by a collet 15 which is captive in an annular groove 3*g* on the inside of the pocketed spacer 3, and which extends into the bore in which the upper flow tube 22 is housed. The collet 15 has inherent resilience, and is normally biased radially inwards. Thus in the absence of any other forces, it contracts the outer surface of the upper flow tube 22. The outer surface of the upper flow tube 22 has three grooves 23, 24 and 25 to receive the collet 15. The upper groove 25 has mutually parallel sides that are perpendicular to the axis of the bore 3*b*, so that when the collet 15 is in the upper groove 25, it prevents relative movement between the collet 15 and the flow tube 22. The lower two grooves 23 and 24 each have one lower side that is perpendicular to the axis of the bore 3*b*, and one upper side that is ramped. Thus, when the collet 15 is in the lower grooves, the flow tube 22 cannot move up relative to the collet 15, because the perpendicular lower side of each groove 23, 24 shoulders out on the collet 15. However, axial downward movement of the flow tube 22 relative to the collet is permitted, because the collet can slide up the ramped upper side of each groove 23, 24 and expand radially out of the groove 3*g*.

The annular groove 3*g* housing the collet 15 connects the bore 3*b* housing the upper flow tube 22 with the axial passage 14 housing the spring 13 and the locking pin 11. The locking pin 11 has a step between a narrow diameter portion 11*a* at its lower end, and a large diameter portion 11*b* at its upper end. When the large diameter portion 11*b* at the upper end of the locking pin is situated over the annular groove 3*g* containing the collet 15, it prevents radial expansion of the collet 15, and keeps it pressed radially inwards into one of the grooves 23, 24 on the outer surface of the upper flow tube 22. The collet 15 cannot travel up the ramped sides of the grooves 23, 24 because it cannot expand radially out of the groove 3*g*, and so when the large diameter portion of the locking pin 11*b* is axially aligned with the groove 3*g*, the collet cannot expand radially, and axial movement of the upper flow tube 22 within the bore 3*b* is thereby prevented. When the narrow diameter portion 11*a* of the locking pin 11 is located over the collet 15 and groove 3*g*, the collet is able to radially expand within the annular groove 3*g*, and thus the collet 15 can radially expand and slide up the ramped sides of the grooves 23, 24, and the upper flow tube 22 can move axially downwards within the bore 3*b*.

The upper flow tube 22 is biased downwards by a spring (not shown) disposed between the upper end of the lower flow tube 20 and the lower end of the upper sub 2. The spring is strong, and is sufficient to drive the flow tube 22 downwards, and thereby radially expand the collet 15 by means of the ramped sides of the grooves 23, 24 on the outside of the upper flow tube 22.

In use, the valve assembly is run into the hole in the open configuration shown in FIGS. 1 to 4. The upper flow tube 22 is locked against axial movement by the collet 15 being radially compressed within the grooves 3*g* and 23. The large diameter portion 11*b* of the locking pin 11 is axially aligned with the collet 15, preventing its expansion, and thereby locking the upper flow tube 22 down and keeping the spring above it in compression. The lower flow tube 20 is at its uppermost position driven axially up against the upper flow tube 22, and keeping the flapper 30 in the pocket p1, preventing its rotation around the pivot pin 6. Thus, fluid is free to flow through the continuous bore 3*b* in either direction.

The valve assembly can be used in this way for circulating fluid in a conventional tool string.

When the flapper valve assembly is to be closed to occlude the bore 3*b*, for example during packer setting or pressure-testing operations, the motor 40 is activated and the nut 42 spins on its axis for the desired number of revolutions to move the lower flow tube 20 axially downwards within the bore 3*b* until the upper end of the lower flow tube 20 is level with the hinge ringer 5, between the pockets p1 and p2. A latch member (not shown) typically keeps the flapper 30 in the pocket p1, and thus prevents movement of the locking pin 11 within the axial channel 14, and thereby prevents axial movement of the upper flow tube 22, by means of the collet 15.

Figure 5:
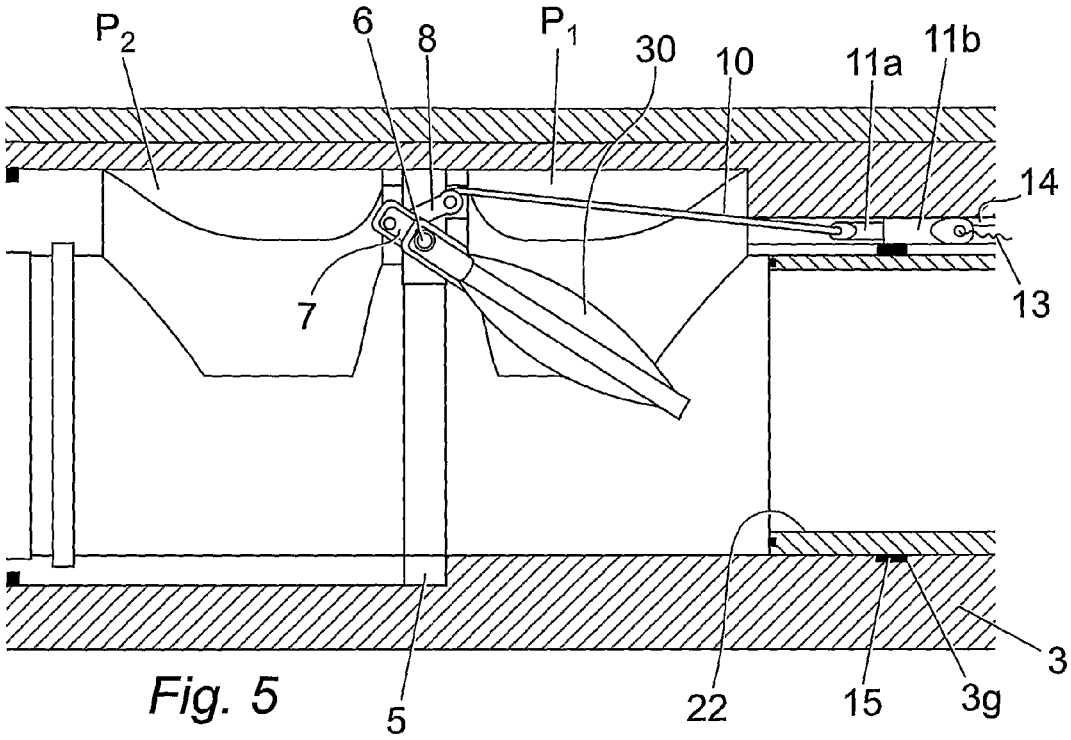
FIG. 5 is a side-sectional view of the FIG. 3 flapper transitioning between the first (open) and a second (closed) position.

Once the lower flow tube 20 has moved downwards away from the upper pocket p1 in which the flapper 30 is housed, the latch is released and the flapper 30 is then free to move down across the bore 3*b*. The tension applied to the flapper 30 by means of the spring 13, transmitted through the locking pin 11, linkage arm 10, elbow link 8 and lever 7 then starts to move the flapper 30 pivotally around the pivot pin 6 as shown in FIG. 5. FIG. 5 is a partial sectional view with the lower flow tube 20 omitted for clarity. Normally the lower flow tube 20 would be in the position shown in FIG. 6.

Figure 6:
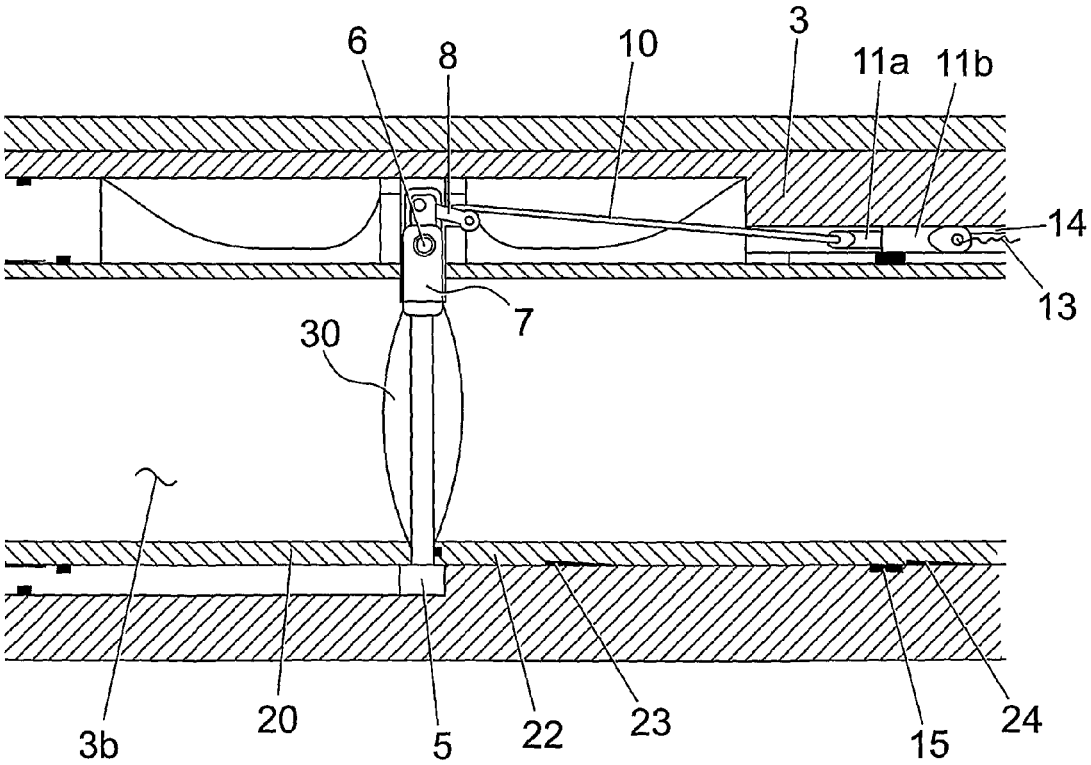
FIG. 6 is a side-sectional view of the FIG. 4 flapper in the second (closed) position.

Optionally, embodiments can be constructed without a latch to keep the flapper 30 in the upper pocket p1 until the lower flow tube 20 has reached the hinge ringer 5. In such embodiments, the force applied by the spring 13 to the flapper 30 to rotate it around the pivot pin 6 can be fairly weak, and the friction and inertial forces involved mean that the lower flow tube 20 has almost reached the hinge ringer 5 as shown in FIG. 6 by the time the flapper 30 starts to rotate around the hinge pin 6 into the bore 3*b* of the pocketed spacer.

As the spring 13 contracts, the large diameter portion 11*b* of the locking pin 11 is pulled upwards in the axial channel 14 as the flapper 30 rotates around the pivot pin 6. Just as the flapper 30 reaches the position shown in FIG. 6 where the flapper 30 is disposed across the axis of the bore 3*b*, the large diameter portion 11*b* of the locking pin 11 clears the annular groove 3*g* containing the collet 15, leaving the collet 15 free to expand radially out of the groove 3*g*. At that point, the spring (not shown) urging the upper flow tube 22 downwards in the bore 3*b* drives the radial expansion of the collet 15 by means of the ramped side of the groove 23 on the outer surface of the upper flow tube 22 so that the upper flow tube 22 moves rapidly downwards to collide with the upper face of the flapper 30 in its closed position as shown in FIG. 6. A seal on the lower face of the upper flow tube 22 mates with a matching annular seal face on the upper side of the flapper 30, and at the point of collision, the collet 15 held in the groove 3*g* is axially aligned with the second groove 24 on the outer surface of the upper flow tube 22. Groove 24 is asymmetric in a similar manner to groove 23, and has one lower perpendicular side, and one upper ramped side. As the lower perpendicular side of the groove 24 passes the collet 15, the collet is able to recoil radially inwards into the groove 24, and has enough inherent resilience to do so without external forces being applied to it. At that point, the lower sealing surface on the end of the upper flow tube 22 is sealed against the upper seal face of the flapper 30. The upper flow tube 22 is pressed against the flapper 30 by the spring above it.

The seal between the upper surface of the upper flow tube 22 and the lower seal face of the flapper 30 is not tight at this point, and there is a certain amount of axial "slop" within the system because of the tolerance of the groove 24 and the collet 15. In order to remove the slop and seal the bore 3*b*, the electric motor 40 is then signalled to initiate axial movement of the lower flow tube 20 back up the bore 3*b* in order to compress its upper seals on its end face against a corresponding annular seal face on the lower surface of the flapper 30. The motor 40 can be driven in reverse until the flapper 30 is tightly sealed between the seal faces of the upper and lower flow tubes. The lower flow tube 20 is typically sealed within the bore of the housing 1 and/or pocketed spacer 3, and optionally the upper flow tube 22 can be sealed in the same way, thereby preventing fluid communication across the flapper 30 while it is in the closed position shown in FIG. 6.

The flapper 30 is now resistant to pressure differentials in either direction. This permits pressure testing or packer setting operations to be carried out.

In some embodiments, the upper flow tube 22 can be initially retained in its upper position shown in FIG. 1 while the lower flow tube 20 is lowered to enable operation of the flapper 30 against the static seat provided by the lower flow tube 20 in a conventional manner. Thus the flapper 30 could be freed to pivot around the pivot pin 6 in and out of the upper pocket p1 with the lower flow tube 20 in the FIG. 6 position, so that fluids flowing up the lower flow tube 20 could pass the flapper 30 in a conventional manner, but fluids flowing in the opposite direction would set up a pressure differential and close the lower seal face of the flapper 30 against the lower flow tube 20.

Alternatively, the upper flow tube 22 can be moved to the position shown in FIG. 6, and latched there, with its lower end axially aligned with the annular hinge ringer 5, and the lower flow tube 20 can be moved down the bore and also latched by separate latching means, so that the flapper 30 can then pivot around the pivot pin 6 in and out of the lower pocket p2 and seat against the seal face on the upper flow tube 22 in the FIG. 6 position, so that fluids flowing down the upper flow tube 22 could pass the flapper 30 in a conventional manner, but fluids flowing in the opposite direction would set up a pressure differential and close the upper seal face of the flapper 30 against the upper flow tube 22. Typically, the flapper 30 can be latched in the closed position until the lower flow tube 20 has cleared the lower pocket p2.

Figure 7:
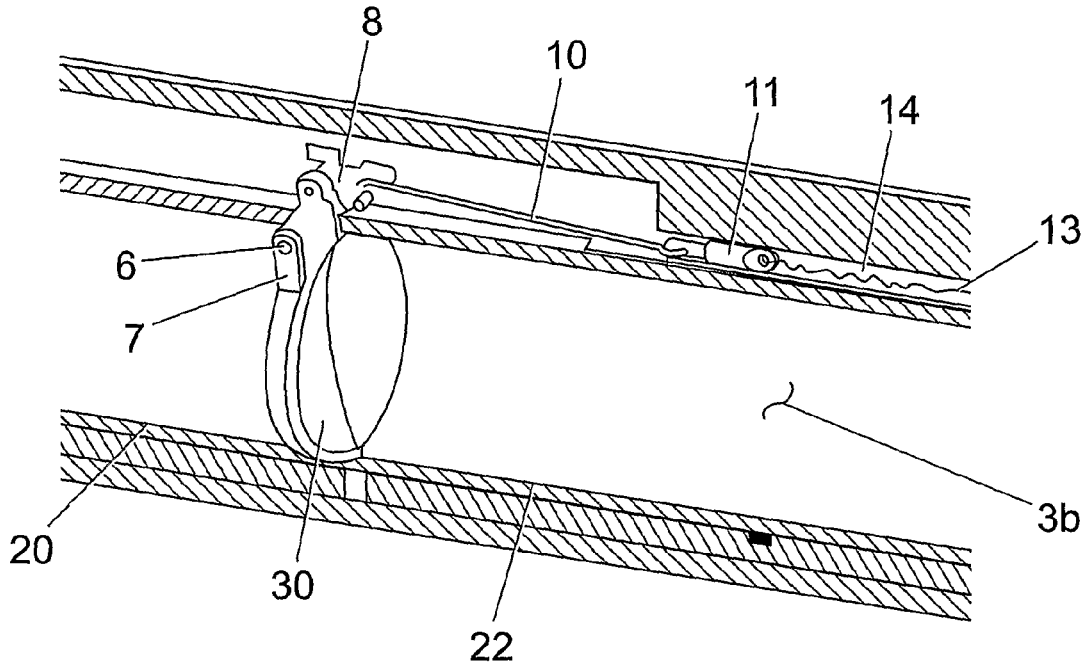
FIG. 7 is a perspective view of the FIG. 5 flapper in the second (closed) position.

Optionally, the collet 15 can be held above the perpendicular side of the groove 24 and kept from expansion by the large diameter portion 11*b* of the locking pin 11 as previously described to prevent the axial movement of the upper flow tube 22 within the bore 3*b*, so that the upper flow tube 22 can remain with its upper seal face in axial alignment with the hinge ringer 5 as shown in FIG. 6 and FIG. 7, and the flapper 30 can seat against the upper flow tube 22, and flap downwards into the lower pocket p2. Fluid flowing down the bore 3*b* can then pass the flapper 30 in the normal way, but fluid flowing up the bore 3*b* sets up a pressure differential across the seal between the upper face of the flapper and the end seals on the upper flow tube 22, which closes the flapper against the seat on the upper flow tube 22 and prevents fluid passage in that direction. If desired the upper flow tube 22 can be latched in position to operate the flapper 30 in this direction for a period of time.

However, in most cases, the seal provided by the flapper 30 being squeezed between the two flow tubes as shown in FIG. 6 is sufficient to permit pressure testing or packer setting, and once these operations are completed, the operator will want to remove the seal completely and resume two-way circulation of fluids within the bore 3*b*. Two-way fluid communication can thus be restored across the flapper 30 after one-way operation in both directions.

Figure 8:
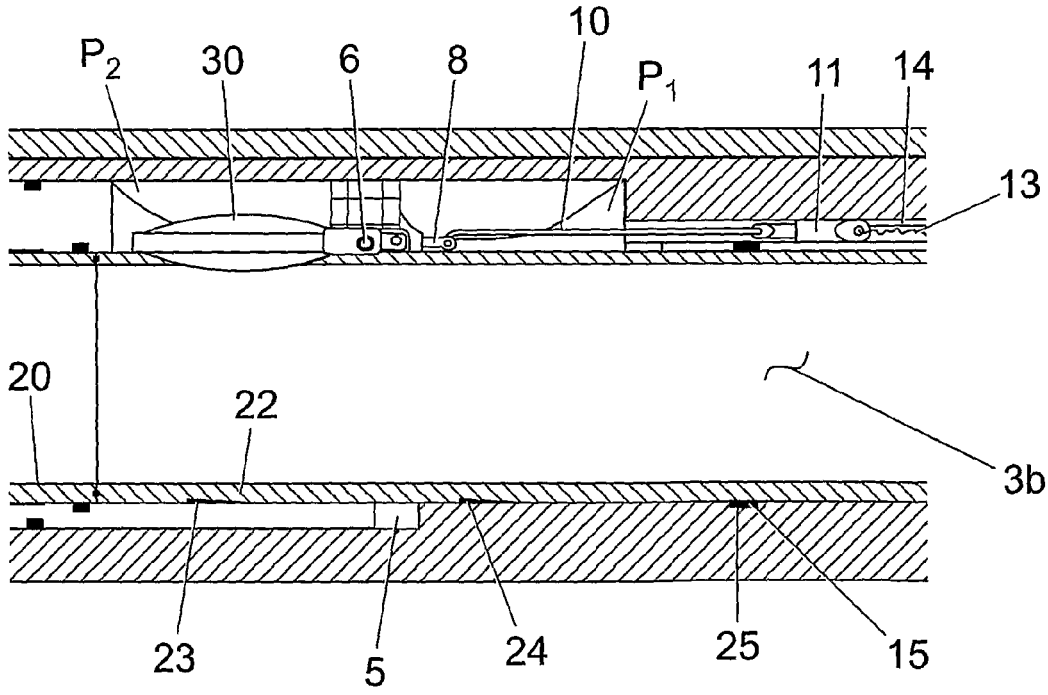
FIG. 8 is a side-sectional view of the flapper in a third (open) position.
Figure 9:
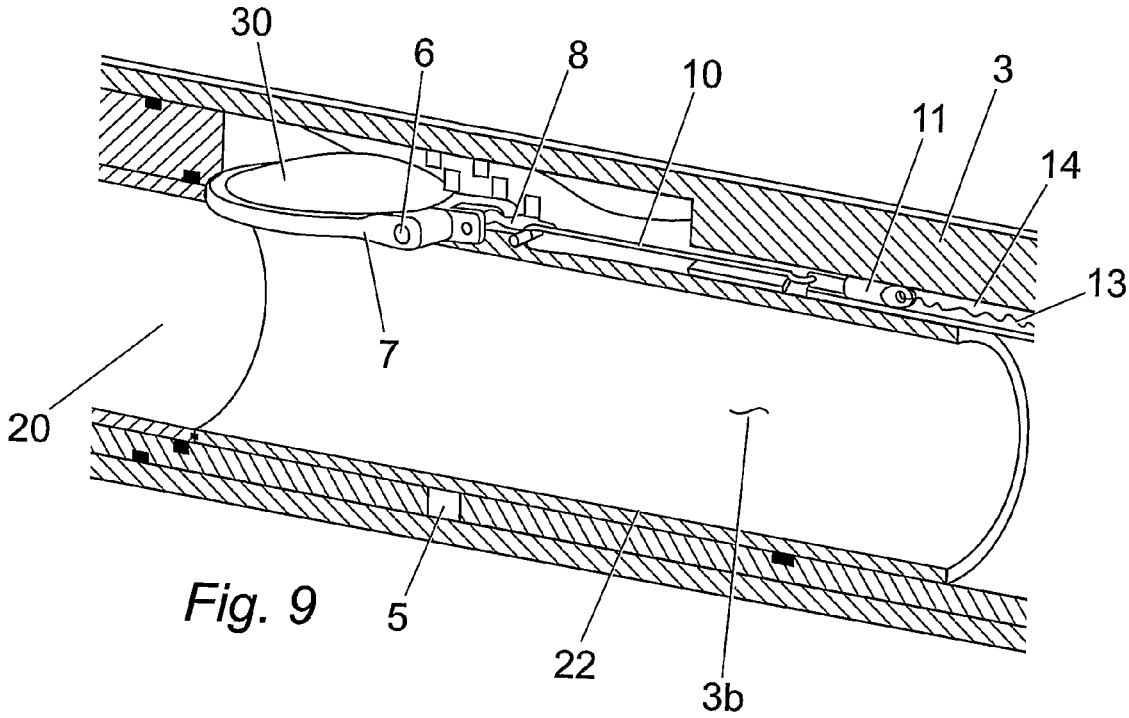
FIG. 9 is a perspective view of the FIG. 7 flapper in the third (open) configuration.
Figure 10:
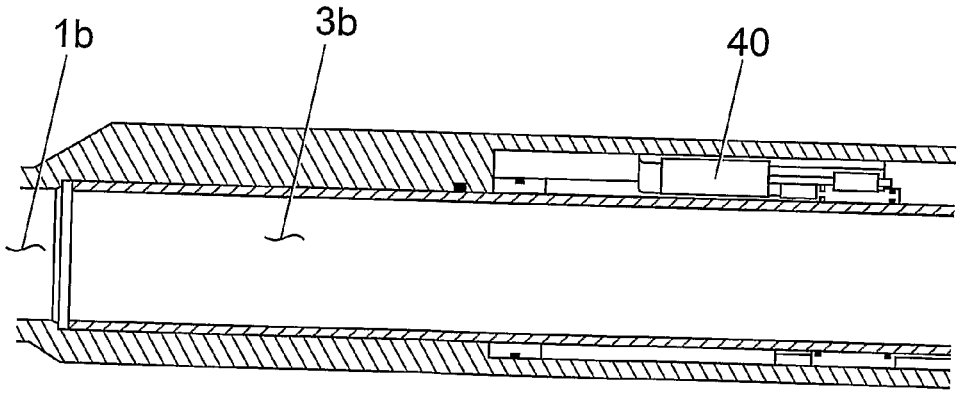
FIG. 10 is a side-sectional view of a motor sub of the valve assembly in the third (open) configuration.

When two way flow through the housing is to be re-established, the lower flow tube 20 is moved axially downwards in the same manner using the electric motor 40 to permit downward movement of the flapper 30 around the pivot pin 6 as shown in FIG. 8.

Once the lower flow tube 20 has moved clear of the lower pocket p2, the upper flow tube 22 can be unlatched to move axially within the bore 3*g*. This can be achieved with by separate latches, or by manipulating the tension of the spring 13 to contract further to pivot the flapper 30 around the pivot pin 6, causing the flapper 30 to enter the lower pocket p2, out of the bore 3*b*, and causing the large diameter portion 11*b* of the locking pin 11 to clear the groove 3*g*, thereby allowing the collet 15 to expand radially and release the upper flow tube 22 for axial movement in the bore 3*b*.

The spring between the upper sub 2 and the upper flow tube 22 then urges the upper flow tube 22 downwards, causing radial expansion of the collet 15 by the ramped side of the groove 24 as previously described.

The disengagement of the locking pin 11 from the collet 15 thus enables the axial movement of the upper flow tube 22 past the hinge ringer 5, under the flapper 30 and into sealing contact with the lower face of the lower flow tube 20. At that point, the collet 15 then snaps into the plain annular groove 25 above the groove 24, thereby locking the upper flow tube 22 against axial movement in either direction. At that point, the electric motor can then be driven again in reverse to move the lower flow tube 20 up in order to press the end seals of the flow tubes together and establish a two-way conduit for flow of fluid through the bore 1*b* of the housing. This also takes up any axial slop in the system.

The concave profile on the upper and lower surfaces of the flapper 30 accommodates the outer surfaces of the flow tubes. In certain embodiments, the flapper can be latched in position within either pocket, or within the closed position.

The flapper 30 and flow tubes 20, 22 can be resettable downhole. The valve assembly can be programmed to cause selective movement of the flapper 30 and flow tubes 20, 22 to a predetermined reset configuration.

Signalling mechanisms used to initiate the electric motor can be of any suitable kind, for example, RFID tags can be dropped through the bore in order to initiate pre-programmed activities of the electric motor, or electric control lines can extend from surface. Pressure pulses in the bore or hydraulic lines can also be used for signalling, or any other conventional signalling pathway currently used for the activation of downhole tools. Other means of actuating the motor can involve the use of a strain gauge, specific chemicals or electromagnetic induction. The motor can typically be powered by onboard batteries housed within the pocketed spacer, or electric power can be supplied from cables within the string. If desired, the motor can be a hydraulic motor and other variations can be incorporated without adhering to the particular embodiments described herein.

The seals between the flapper and the flow tubes can be carried on the flow tubes or the flapper. The seals can be metal-to-metal or conventional resilient seals. The precise form of seal is not critical. In some embodiments, it may be preferable to provide one seal on a flow tube, and the other seal in the flapper, depending on the orientation of the flapper.

Clearly, the flapper can operate in either direction, and possible embodiments are not limited to those described herein.

Modifications and improvements can be incorporated without departing from the scope of the invention.

The invention claimed is:

1. A valve assembly comprising:

a fluid conduit with a bore for the passage of fluid therethrough;

a sealing member that is pivotally movable within the conduit to open and close the bore wherein the sealing member is pivotable through more than 90°;

wherein the sealing member has a first open configuration and a third open configuration in which the bore of the conduit is open, the third open configuration being different from the first open configuration, and a second closed configuration in which the bore of the conduit is closed to substantially restrict fluid passage therethrough, and wherein the second closed configuration is between the first and third open configurations.

2. A valve assembly according to claim 1, wherein the valve assembly has a first valve seat on which the sealing member seals when the bore is closed, and wherein the first valve seat is movable within the conduit.

3. A valve assembly according to claim 2, wherein the valve seat is movable between a sealing configuration in which the sealing member engages with the valve seat to seal the bore, and an open configuration, in which the sealing member cannot engage the seat.

4. A valve assembly according to claim 2, wherein the seat is axially movable within the bore.

5. A valve assembly according to claim 1, wherein the sealing member is biased by a spring device towards the second closed configuration.

6. A valve assembly according to claim 1, wherein the sealing member is biased by the spring device from the first open configuration towards the third open configuration via the second closed configuration.

7. A valve assembly according to claim 5, wherein the spring device is selected from the group consisting of: a tension spring and a torsion spring.

8. A valve assembly according to claim 2, wherein the sealing member is pivotally movable within the bore, and the seat is movable axially relative to the pivot point of the sealing member.

9. A valve assembly according to claim 2, wherein a second valve seat is provided on which the sealing member is sealable when the bore is closed.

10. A valve assembly according to claim 9, wherein the second valve seat is movable relative to the sealing member.

11. A valve assembly according to claim 9, wherein the valve seats are mounted on the end faces of sleeves that slide within the bore of the conduit.

12. A valve assembly according to claim 11, wherein the sleeves are urged by spring devices so that the sleeves are moveable through the conduit.

13. A valve assembly according to claim 1, wherein the valve assembly is resettable into at least one predetermined configuration.

14. A valve assembly according to claim 1, wherein the sealing member is hinged at one side and the hinge permits pivotal movement through more than 90° of rotation around the hinge.

15. A valve assembly according to claim 14, wherein the hinge permits more than 180° of movement.

16. A valve assembly according to claim 9, wherein at least one of the first and second valve seats is movable relative to the sealing member.

17. A valve assembly, according to claim 9, wherein the sealing member is sealable against at least one of the valve seats.

18. A valve assembly according to claim 9, wherein both the first and second valve seats are movable axially within the conduit.

19. A valve assembly according to claim 1, wherein the valve assembly is actuable by any of the following; a timer; a radio frequency identification tag; a strain gauge; a pressure pulse; a chemical; and an electromagnetic switch.

20. A valve assembly according to claim 1, wherein the valve assembly is a flapper valve assembly and the sealing member is a flapper.

* * * * *